United States Patent [19]

Walter et al.

[11] Patent Number: 4,792,774

[45] Date of Patent: Dec. 20, 1988

[54] DIELECTRIC WAVEGUIDE HAVING HIGHER ORDER MODE SUPPRESSION FILTERS

[75] Inventors: Jeffrey A. Walter, Wilmington; Kailash C. Garg, Newark; Joseph C. Rowan, Wilmington, all of Del.

[73] Assignee: W. L. Gore & Associates, Inc., Newark, Del.

[21] Appl. No.: 101,987

[22] Filed: Sep. 29, 1987

[51] Int. Cl.[4] ..... H01P 1/162

[52] U.S. Cl. ..... 333/251; 333/339

[58] Field of Search ..... 333/239, 240, 242, 248, 333/251

[56] References Cited

U.S. PATENT DOCUMENTS

| | | | |
|---|---|---|---|
| 3,703,690 | 11/1972 | Ravenscroft et al. | 333/251 X |
| 4,040,061 | 8/1977 | Roberts et al. | 333/251 X |
| 4,344,053 | 8/1982 | Anderson | 333/251 |
| 4,463,329 | 7/1984 | Suzuki | 333/339 |
| 4,525,693 | 6/1985 | Suzuki et al. | 333/242 X |

*Primary Examiner*—Paul Gensler

*Attorney, Agent, or Firm*—Mortenson & Uebler

[57] ABSTRACT

A dielectric waveguide for the transmission of electromagnetic waves is provided comprising a core of polytetrafluoroethylene (PTFE), one or more layers of PTFE cladding overwrapped around the core, the core and/or cladding having mode suppression filters of an electromagnetically glossy material embedded therein, and an electromagnetic shielding layer covering the cladding. The mode suppression filters are preferably mica cards.

19 Claims, 1 Drawing Sheet

DIELECTRIC WAVEGUIDE HAVING HIGHER ORDER MODE SUPPRESSION FILTERS

BACKGROUND OF THE INVENTION

This invention relates to a dielectric waveguide for the transmission of electromagnetic waves. More particularly, the invention relates to a dielectric waveguide having higher order mode suppression filters.

Electromagnetic fields are characterized by the presence of an electric field vector E orthogonal to a magnetic field vector H. The oscillation of these components produces a resultant wave which travels in free space at the velocity of light and is transverse to both of these vectors. The power magnitude and direction of this wave is obtained from the Poynting vector given by:

$$P=E\times H(Watts/m^2)$$

Electromagnetic waves may exist in both unbounded media (free space) and bounded media (coaxial cable, waveguide, etc.). This invention relates to the behavior of electromagnetic energy in a bounded medium and, in particular, in a dielectric waveguide.

For propagation of electromagnetic energy to take place in a bounded medium, it is necessary that Maxwell's Equations are satisfied when the appropriate boundary conditions are employed.

In a conventional metal waveguide, these conditions are that the tangential component of the electric field, $E_t$, is zero at the metal boundary and also that the normal component of the magnetic flux density, $B_n$, is zero.

The behavior of such a waveguide structure is well understood. Under excitation from external frequency sources, characteristic field distributions or modes will be set-up. These modes can be controlled by variation of frequency, waveguide shape and/or size. For regular shapes, such as rectangles, squares or circles, the well-defined boundary conditions mean that operation over a specific frequency band using a specific mode is guaranteed. This is the case with most rectangular waveguide systems operating in a pure $TE_{10}$ mode. This is known as the dominant mode in that it is the first mode to be encountered as the frequency is increased. The $TE_{mn}$ type nomenclature designates the number of half sinusoidal field variations along the x and y axes, respecitvely.

Another family of modes in standard rectangular waveguides are the $TM_{mn}$ modes, which are treated in the same way. They are differentiated by the fact that $TE_{mn}$ modes have no $E_z$ component, while $TM_{mn}$ modes have no $H_z$ component.

The dielectric waveguide disclosed in U.S. Pat. No. 4,463,329 does not have such well-defined boundary conditions. In such a dielectric waveguide, fields will exist in the polytetrafluoroethylene (PTFE) cladding medium. Their magnitude will decay exponentially as a function of distance away from the core medium. This phenomena also means that, unlike conventional waveguides, numerous modes may, to some degree, be supported in the waveguide depending upon the difference in dielectric constant between the mediums, the frequency of operation and the physical dimensions involved. The presence of these so-called "higher order" modes is undersirable in that they extract energy away from the dominant mode, causing excess loss. They cause, in certain cases, severe amplitude ripple and they contribute to poor phase stability under conditions of flexure.

A launching horn employed in conjunction with a waveguide taper performs a complex impedance transformation from conventional waveguide to the dielectric waveguide. Techniques such as the finite element method may be used to make this transformation as efficient as possible. However, the presence of any impedance discontinuity will result in the excitation of higher order modes.

Having described the ways in which higher order modes may be stimulated in such a dielectric waveguide assembly, mode filters for suppressing their presence will now be disclosed.

SUMMARY OF THE INVENTION

A dielectric waveguide for the transmission of electromagnetic waves is provided comprising a core of PTFE, one or more layers PTFE cladding overwraped around the core, mode suppression filters of an electromagnetically lossy material embedded in the core and/or cladding, and an electromagnetic shielding layer covering the cladding. The mode suppression filters may be affixed to a launcher. The mode suppression filters are preferably mica cards. The core may be extruded, unsintered PTFE; extruded, sintered PTFE; expanded, unsintered, porous PTFE; or expanded, sintered, porous PTFE. The core may contain a filler. The cladding layer(s) may be extruded, unsintered PTFE; extruded, sintered PTFE; expanded, unsintered, porous PTFE; or expanded, sintered, porous PTFE. The cladding layer(s) may contain a filler. The electromagnetic shielding layer covering the cladding preferably is aluminized tape, and most preferably is aluminized Kapton® polyimide tape. The dielectric waveguide may be further overwrapped with a tape of carbon-filled PTFE.

Figure 1:
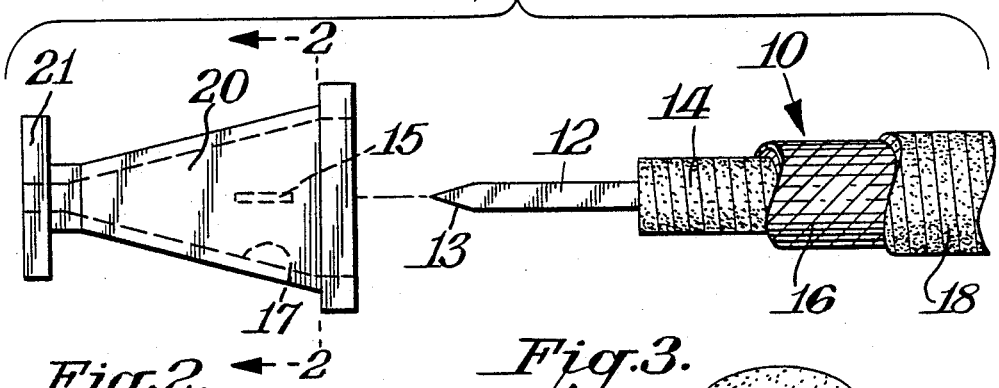
FIG. 1 is a side elevation, with parts of the dielectric waveguide cut away for illustration purposes, of the dielectric waveguide according to the invention and showing one launcher.

DETAILED DESCRIPTION OF THE INVENTION AND PREFERRED EMBODIMENTS WITH REFERENCE TO THE DRAWINGS

A dielectric waveguide for the transmission of electromagnetic waves is provided comprising a core of polytetrafluoroethylene (PTFE), one or more layers of PTFE cladding overwrapped around the core; the core and/or cladding having mode suppression filters of an electromagnetically lossy material embedded therein, and an electromagnetic shielding layer covering the cladding. The mode suppression filters are preferably mica cards.

The composition of the higher order modes which are created and supported in the dielectric waveguide assembly have field distributions which are unique from the desired, fundamental mode of propagation. Subsequently, it is possible to filter out these unwanted modes by consideration and placement in the waveguide of resistive cards such as mica. Placement of the mica cards should be such that there is little or no interruption of the desired mode.

Because the desired mode is vertically polarized, it has no component in the same plane as the filters. However, the presence of $TE_{mn}$ and $TM_{mn}$ modes, where $n \neq O$, would mean that the filtering action would start to take place on these modes, thus leading to their attenuation. Depending upon the desired effect, these cards can be oriented as desired. They may be of arbitrary shape, but are preferably of the shapes shown in the drawings described below. These shapes ensure that there is a smooth transition into the launcher rather than an abrupt discontinuity, which would mean that the incident energy would be reflected rather than absorbed.

The filters may be inserted into the cladding by slitting the cladding and fitting them in place. Alternatively, they may be embedded in the core by forming a slot and inserting them or simply forcing them into the core.material. Another method is to cast or secure them in the launching horn.

A detailed description of the invention and preferred embodiments is best provided with reference to the accompanying drawings.

FIG. 1 shows the dielectric waveguide of the invention, with parts of the dielectric waveguide cut away for illustration purposes. When lauancher 20 with conventional flange 21 is connected to dielectric waveguide 10, electromagnetic energy enters the launcher 20. An impedance transformation is carried out in the taper 13 of the core 12 of waveguide 10 such that the energy is coupled efficiently into the core 12 of dielectric waveguide 10. Once captured by the core 12, propagation takes place through the core 12 which is surrounded by cladding 14. The core 12 is polytetrafluoroethylene and the cladding 14 is polytetrafluoroethylene, preferably expanded, porous polytetrafluoroethylene tape overwrapped over core 12. A cladding layer of polytetrafluoroethylene may be extruded over core 12. Propagation uses the core/cladding interface to harness the energy. Mode suppression filters 15 may be secured to the wall of launcher 20. The filters 15 are of an electromagnetically lossy material. Preferably, the mode suppression filters 15 are mica cards.

To prevent cross-coupling or interference from external sources, an electromagnetic shield 16 is provided as well as an external absorber 18. The shield is preferably aluminized Kapton® polyimide tape, and the absorber is preferably carbon-filled PTFE tape.

Figure 2:
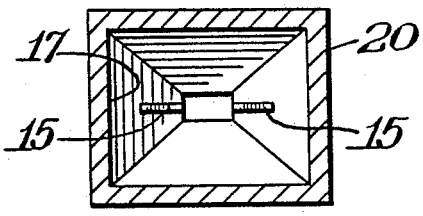
FIG. 2 is an elevational view, partly in cross section, of the launcher 20 taken along line 2—2 of FIG. 1.

FIG. 2 is an elevational view, partly in cross section, taken along line 2—2 of FIG. 1. Within the opening 17 of launcher 20, the mode suppression filters 15 are secured to the launching horn 20 such that, upon insertion of the waveguide 10 into the horn 20, the filters 15 may or may not penetrate and become embedded within the cladding 14.

Figure 3:
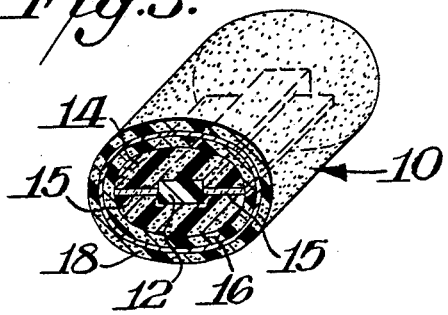
FIG. 3 is a pictorial view, partly in cross section, of the waveguide and mode suppression filters according to the invention.

FIG. 3 is a pictorial view, partly in cross section, of the waveguide 10 according to the invention and showing the core 12 surrounded by cladding 14, electromagnetic shield layer 16 and external absorber layer 18. In this embodiment, rectangular mica cards 15 are inserted into slits in the cladding 14 and are oriented in the horizontal plane as shown adjacent the core 12.

Figure 4:
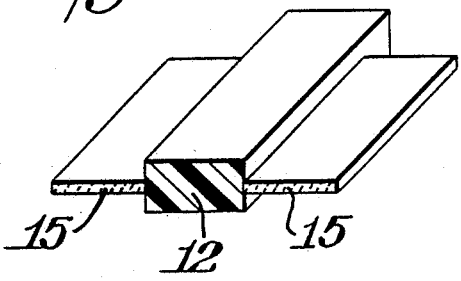
FIGS. 4, 5 and 6 are pictorial views of alternate emobidments of the waveguide core and mode suppression filters according to the invention with the cladding and outer layers omitted for clarity of illustration.

FIG. 4 shows a pictorial view, partly in cross section, of core 12 having mode suppression filters 15 located adjacent thereto as shown. The cladding and outer coverings are omitted for clarity of illustration.

Figure 5:
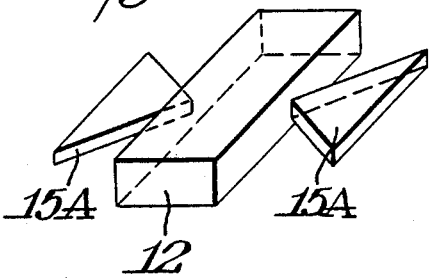

FIG. 5 shows an alternate embodiment of core 12 having triangular shaped mode suppression filters 15A positioned adjacent thereto.

Figure 6:
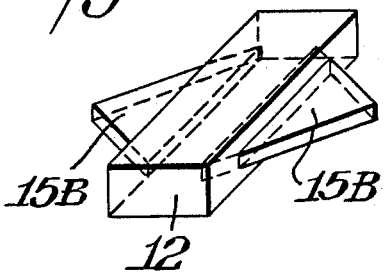

FIG. 6 shows a further alternate embodiment of core 12 having triangular shaped mode suppression filters 15B positioned adjacent thereto in an inverted configuration from that of FIG. 5. The cladding and outer coverings are omitted from FIGS. 5 and 6 for clarity of illustration.

While the invention has been disclosed herein in connection with certin embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A dielectric waveguide for the transmission of electromagnetic waves comprising:

(a) a core of PTFE;

(b) one or more layers of PTFE cladding overwrapped around said core;

(c) mode suppression filters of an electromagnetically lossy material embedded in said waveguide; and (d) an electromagnetic shielding layer covering said cladding.

2. The dielectric waveguide of claim 1 wherein said mode supression filters are embedded in said cladding.

3. The dielectric waveguide of claim 1 wherein said mode suppression filters are embedded in said core.

4. The dielectric waveguide of claim 1 wherein said mode suppression filters are mica cards.

5. The dielectric waveguide of claim 1 wherein said core is extruded, unsintered PTFE.

6. The dielectric waveguide of claim 1 wherein said core is extruded, sintered PTFE.

7. The dielectric waveguide of claim 1 wherein said core is expanded, unsintered, porous PTFE.

8. The dilectric waveguide of claim 1 wherein said core is expanded, sintered, porous PTFE.

9. The dielectric waveguide of claim 1 wherein said core contains a filler.

10. The dielectric waveguide of claim 1 wherein said one or more layers of PTFE cladding is extruded, unsintered PTFE.

11. The dielectric waveguide of claim 1 wherein said one or more layers of PTFE cladding is extruded, sintered PTFE.

12. The dielectric waveguide of claim 1 wherein said one or more layers of PTFE cladding is expanded, unsintered, porous PTFE.

13. The dielectric waveguide of claim 1 wherein said one or more layers of PTFE cladding is expanded, sintered, porous PTFE.

14. The dielectric waveguide of claim 1 wherein said one or more layers of PTFE cladding contains a filler.

15. The dielectric waveguide of claim 1 wherein said shielding layer is aluminized tape.

16. The dielectric waveguide of claim 15 wherein said tape is aluminized Kapton® polyimide tape.

17. The dielectric waveguide of claim 15 overwrapped with a tape of carbon-filled PTFE.

18. The dielectric waveguide of claim 16 overwrapped with a tape of carbon-filled PTFE.

19. The dielectric waveguide of claim 1 in combination with a launching horn wherein said mode suppression filters are secured to said launching horn.

* * * * *

UNITED STATES PATENT AND TRADEMARK OFFICE

CERTIFICATE OF CORRECTION

PATENT NO. : 4,792,774

DATED : December 20, 1988

INVENTOR(S) : Jeffrey A. Walter, Kailash C. Garg, Joseph C. Rowan

It is certified that error appears in the above-identified patent and that said Letters Patent is hereby corrected as shown below:

In the Abstract, line 6, please change "glossy" to --lossy--.

In col. 4, line 14, please change "certin" to --certain--.

Signed and Sealed this

Twentieth Day of June, 1989

*Attest:*

DONALD J. QUIGG

*Attesting Officer*

*Commissioner of Patents and Trademarks*